United States Patent [19]

Lambert, Jr. et al.

[11] 4,349,194

[45] Sep. 14, 1982

[54] APPARATUS FOR EXERCISING THE INNER AND OUTER THIGH MUSCLES

[76] Inventors: Lloyd J. Lambert, Jr.; Lloyd J. Lambert, Sr., both of 1538 College Ave., South Houston, Tex. 77587

[21] Appl. No.: 179,726

[22] Filed: Aug. 20, 1980

[51] Int. Cl.[3] ..... A63B 21/06

[52] U.S. Cl. ..... 272/118; 272/DIG. 4; 272/134; 272/143

[58] Field of Search ..... 272/118, 134, 143, 144, 272/117, 93, 130, 131

[56] References Cited

U.S. PATENT DOCUMENTS

| | | | |
|---|---|---|---|
| 4,125,258 | 11/1978 | McArthur | 272/144 X |
| 4,149,713 | 4/1979 | McLeod | 272/134 X |
| 4,149,714 | 4/1979 | Lambert | 272/118 |
| 4,240,627 | 12/1980 | Brentham | 272/134 X |

*Primary Examiner*—Richard C. Pinkham

*Assistant Examiner*—William R. Browne

*Attorney, Agent, or Firm*—Victor J. Evans & Co.

[57] ABSTRACT

Apparatus for exercising the inner and outer thigh muscles of an individual which includes a frame having a seat and a weight cage of a weight movable upwardly from a rest position with pivotally mounted leg receiving frames for accommodating the legs of an individual on the seat movable independently in an arcuate path from a predetermined rotary position corresponding to the rest position of the weight by lateral movement of the individual's legs with a chain and sprocket drive for drivably connecting each leg receiving frame to a respective D-shaped cam connected in turn to the weight so that pivotal movement of each of the leg receiving frames from the predetermined rotary position moves the weight upwardly to provide resistance to such lateral leg movement thereby exercising the inner and outer thigh muscles of the individual.

16 Claims, 6 Drawing Figures

APPARATUS FOR EXERCISING THE INNER AND OUTER THIGH MUSCLES

BACKGROUND OF THE INVENTION

The emphasis on physical development today has led to a proliferation of various type of machines which permit an individual to undergo body building exercises while remaining in a relatively stationary position. Virtually all of such exercise machines utilize weights slidably mounted for vertical movement in a weight cage movable upwardly from a rest position into an elevated position so as to offer resistance to the efforts expended by the individual performing the exercise. Such machines are generally adapted to permit the individuals to execute body movements of a general nature such as through the arms and legs, bending of the body or the like to move the weights into an elevated position for physical conditioning and development. A basic drawback of most exercise machines available today springs from their simplistic construction which produces a rather general over-all muscular conditioning with attendant general toning of the individual's body. While such a result is unquestionably beneficial, the typical individual's muscular structure is usually uneven or unequal so that such machines fail to permit the individual to focus on certain muscles which the individual may wish to bring up to the general muscular level of the body. This imposes severe limitations on an individual who may be engaged in a specific sport such as track, tennis, ice skating or the like which require exceptional muscular development of a specific set of muscles to the exclusion of other muscles which are called upon frequently in the practice of the sport.

OBJECTS AND SUMMARY OF THE INVENTION

Accordingly, a primary object of the invention is to provide a new and novel exercise machine for exercising the muscles of the legs.

Another object of the invention is to provide a new and novel exercise machine for physical development of the inner and outer thigh muscles in an individual's legs.

A still further object of the invention is to provide a new and novel exercise machine for the inner and outer thigh muscles of a person's legs which permit an individual to focus efforts on physical development of either the inner or outer thigh muscles or both simultaneously.

Still another object of the invention is to provide a new and novel exercise machine for exercising the inner and outer thigh muscles of an individual's legs which is simple and inexpensive in construction, which permits the application of a varying a resistance to a selected muscular area of one or both legs of the individual and which may be easily adjusted for exercising such muscles in either direction or in any starting position.

A still further object of the invention is to provide a new and novel machine for exercising specific muscles in an individual's legs to the exclusion of other muscles in the individual's body.

The objects of the invention and other related objects are accomplished by the provision of a frame having a seat and a weight cage in which weights are guidably disposed for vertical movement between a rest position and an elevated position. The frame also includes leg receiving means for each leg of an individual which are pivotally mounted for independent rotary movement in an arcuate path from a predetermined rotary position. Drive means are provided for drivably connecting the mounting means for the leg receiving means to the weights means and the drive means are adapted to move the weights means from the rest position corresponding to the predetermined rotary position of the legs receiving means in an arcuate path into an elevated postion by lateral movement of the individual's legs thereby exercsing the inner and outer thigh muscles of the individual.

Other objects and advantages will become apparent in the following specification when considered in light of the attached drawings.

DESCRIPTION OF THE PREFERRED EMBODIMENT

Figures 1, 2, 3, 6:
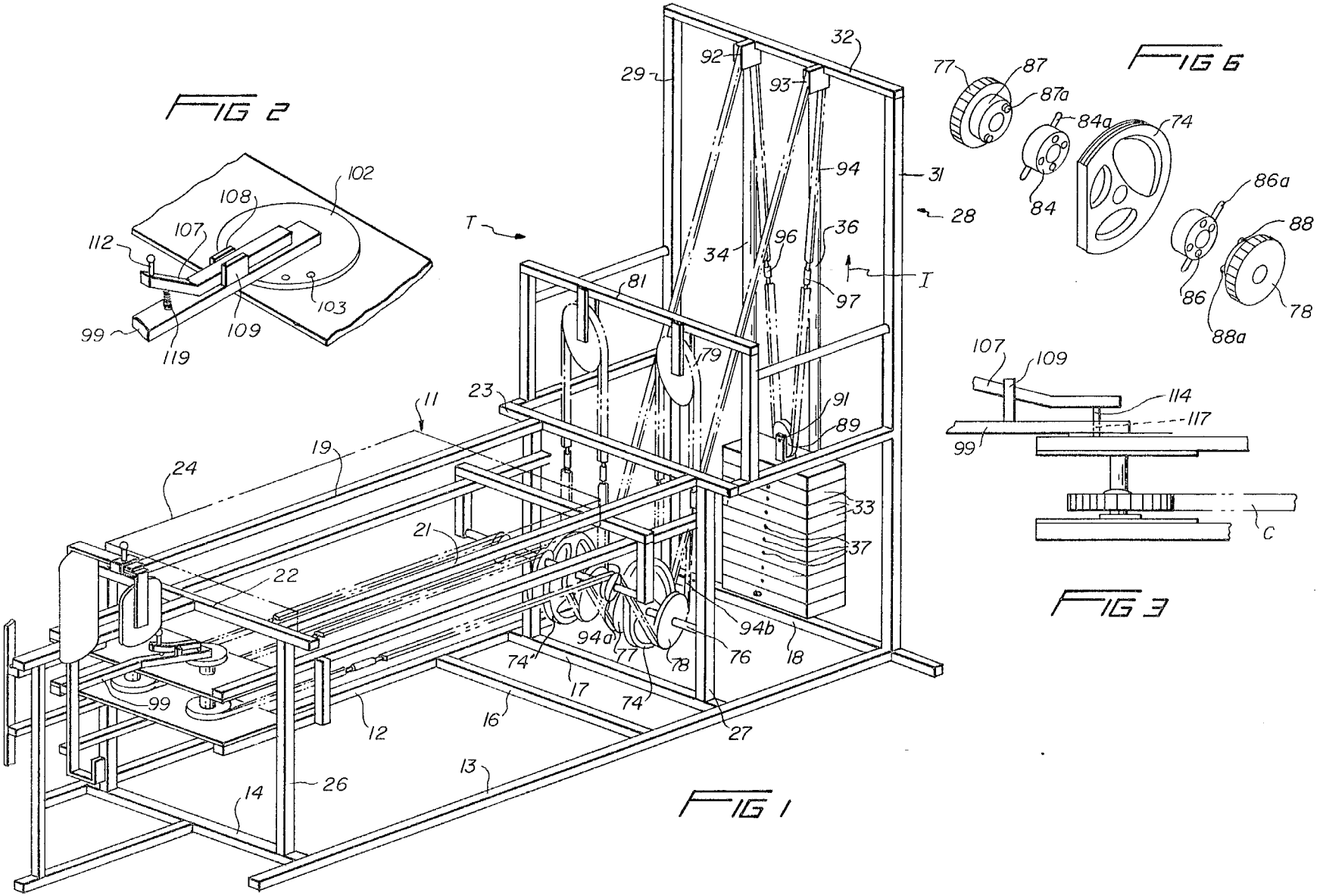
FIG. 1 is a perspective view of the exercising machine of the invention.
FIG. 2 is an enlarged prospective view of a portion of the exercise machine of FIG. 1.
FIG. 3 is a fragmentary side elevation view of a portion of the machine of FIG. 1.
FIG. 6 is a perspective view of a portion of the drawing arrangement incorporated in the machine of FIG. 1.

Referring now to the drawings and to FIG. 1 in particular, there is shown an exercise machine constructed in accordance with the invention and designated generally by the letter T. The machine T includes a frame designated generally by the numeral 11 having longitudinally extending bottom cross members 12, 13 interconnected by cross members 14, 16, 17 and 18 which frame members being engageable with a supporting surface such as a floor on which the machine T is positioned. The frame 11 also includes longitudinally extending upper frame members 19, 21 interconnected by cross members 22, 23. Seat means such as a seat 24 is suitably mounted on the frame 11 by means such as upstanding forward and rear posts 26, 27 suitably secured at their lower ends to cross members 14, 17 respectively.

The frame 11 also includes a weight cage designated generally by the reference numeral 28 which includes upstanding laterally spaced frame members 29, 31 interconnected at their upper ends by means of cross member 32. Weight means such as weights 33 are guidably mounted in the weight cage 28 for vertical movement upwardly in the direction of the arrow I from the rest position of FIG. 1 to an elevated position. As is well known, guide means such as rods 34, 36 are provided in the weight cage 28 for guiding the upward movement of the weights 33 to an elevated position the weights 33 being provided with pins 37 for presetting the magnitude of the weight imposed by the weights 33.

A pair of leg receiving means designated generally by the reference numerals 41, 42 are provided on the forward end of the machine frame 11 each of the leg receiving means 41, 42 being pivotally mounted for independent pivotal movement in an arcuate path laterally of the frame 11. More specifically, support frames 45, 46 of substantially U-shaped construction are pivotally mounted on vertical shafts 49, 51 respectively the vertically extending shafts 49, 51. The shafts 49, 51 are rotatably mounted on the frame 11 by suitable means such as transversely extending vertically spaced plates 52, 53 suitably at opposite ends on the posts 26 as shown.

Each of the support frames 47, 48 include a substantially L-shaped upstanding member 54, 56 having foot rests 57, 58 respectively supported at their lower ends for accommodating a foot of the user on the seat 24. The pads 43, 44 and 45, 46 are suitably mounted on the upper end portions of the members 54, 56 respectively. Each pair of pads 43, 44 and 45, 46 are arranged in spaced-apart relationship for accommodating the knee of one of the legs of the user and means are provided for adjusting the spaced-apart relationship of each pair of pads. More specifically, the upper ends of each of the members 54, 56 are provided with end portions **54*a*, 56*a*, which are provided with longitudinally spaced apertures 61, 62 respectively. The apertures 61, 62 are arranged to accommodate a spring loaded pin 63, 64 provided on sleeves 66, 67 secured to L-shaped brackets 68, 69 on which the pads 43, 45 respectively are attached. The spacing between pads 43, 44 and pads 45, 46 may be easily adjusted by withdrawing the pins 63, 64 from the apertures 61, 62 in which it is located and moving the pads 43, 45 into the desired spaced relationship with the adjacent pad 44, 46 respectively whereupon the pins 63, 64 are released for engagement with the underlying aperture 61, 62 in the end portions 54*a*, 56*a*** respectively.

Figure 4:
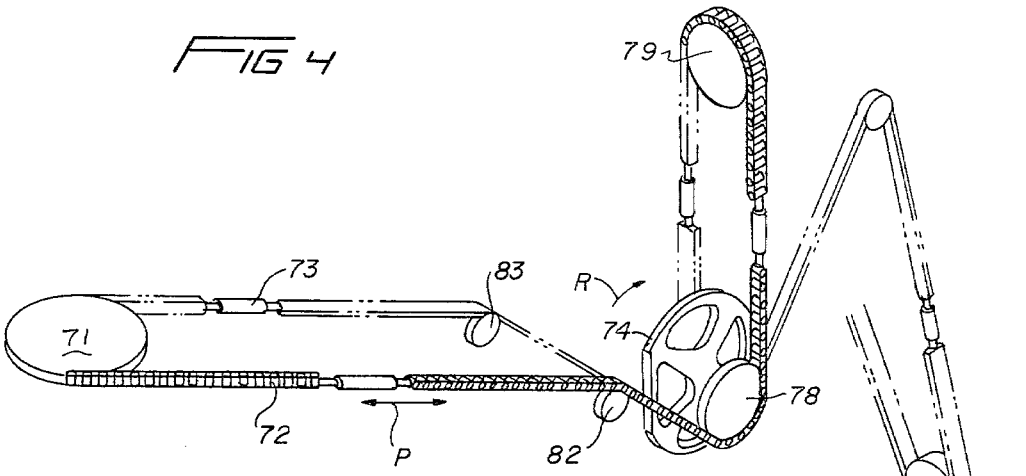
FIG. 4 is a schematic illustration of the drive means incorporated in the machine of FIG. 1.
Figure 5:
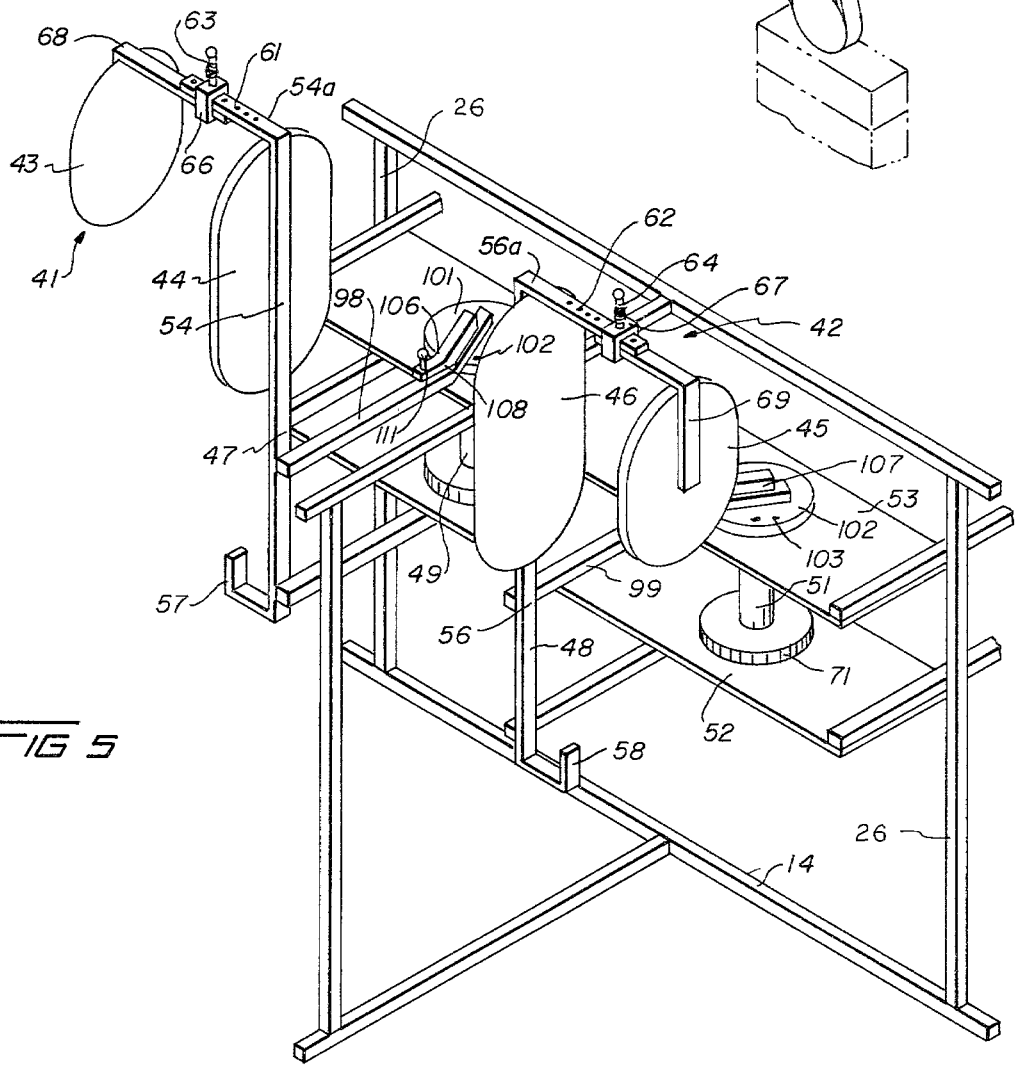
FIG. 5 is an enlarged perspective view of the machine of FIG. 1 taken from the front.

Drive means are provided for drivably connecting each of the support frames 47, 48 to the weights 33 for moving the weights 33 from the rest position of FIG. 1 corresponding to a predetermined rotary position of the support frames 47, 48 and including the leg receiving means 41, 42 on an arcuate path into an elevated position by lateral movement of the user's legs. More specifically, and as shown best in FIG. 4, each of the vertical shafts 49, 51 of the leg receiving means 41, 42 respectively are provided with a chain and sprocket assembly which includes a drive sprocket 71 and a continuous chain 72 having an adjuster 73. The chain and drive assembly for each of the leg receiving 41, 42 means have like parts and are identified by like numerals with the parts associated with the leg receiving means 41 containing the prime notation.

Each of the chain and drive assemblies also includes a D-shaped cam 74 rotatably mounted on the frame 11 by means of a transversely extending shaft 76 together with a pair of drive sprockets 77 mounted on the shaft 76 on opposite sides of the cam 74. An intermediate sprocket 79 is mounted on a cross member 81 on the frame 11 above the D-shaped cam 74. Thus, the chain 72 extends around the drive sprocket 71, over an idler sprocket 82, under one of the drihown in Figure sleeves 84, 86 having diametrically opposed pins **84*a*, 86*a* are secured to the cam 74 on opposite sides for driving engagement with pins 87*a*, 88*a* are provided on sleeves 87, 88 mounted on the sprockets 77, 78 respectively on the sides of the sprockets 72, 78 adjacent the respective side of the cam 74. The associated pairs of pins 87*a*, 84*a* and 86*a* 88*a* thus arranged for driving engagement alternatively in accordance with the direction of advance of the chain 72 rotate the cams 74 in the direction of the arrow R. The associated pairs of pins 87*a*, 84*a* and 86*a*, 88*a* are disposed in a 180° offset relationship so that when one of the sprockets 77, 78** is driven the associated pairs of pins of the driven sprocket are in driving engagement while the offset relationship between the other associated pairs of pins for the none-driven sprocket are out of engagement and slide relative to each other due to the lost motion resulting from the offset relationship.

Chain and sprocket means are provided for connecting the cam 74 to the weights 33. More specifically, a sprocket 89 is rotatably mounted on the top of the weights 33 by means of a bracket 91 and a pair of idler sprockets 92, 93 are mounted in laterally disposed relationship on the weight cage cross member 32 as shown best in FIG. 1. A chain 94 having adjustment elements 96, 97 is connected at it's ends **94*a*, 94*b* to the cams 74, 74' respectively and extends from the cam 74 upwardly around the first idler sprocket 93 downwardly under the sprocket 89 upwardly around the second idler sprocket 92 and back to the other cam 74'. Thus, rotation of either of the cams 74, 74' in the direction of the arrow R produces an upper movement of the weight 33 from the rest position of FIG. 1 into an elevated position as the individual seated on the seat means 24 moves one or both legs laterally to bring about a rotation of the cam 74, 74'**.

Means are provided in the machine T for positioning the leg receiving means in a predetermined rotary position. More specifically, each of the support frames 47, 48 include an upper member 98, 99 respectively the outer ends of which are connected to the upper end of the vertical shafts 49, 51 respectively. There are also mounted on the upper ends of the vertical shafts 49, 51 are discs 101, 102 respectively in the upper service of which apertures 102, 103 are provided. As shown best in FIGS. 2, 3 each of the members 98, 99 are provided with a pivotally mounted operating lever 106, 107 pivotally mounted by means of spaced-apart brackets 108, 109 one end of the levers 108, 109 is provided with an operating knob 111, 112 respectively and the opposite end of the levers are provided with downwardly depending pins 113, 114 receivable within apertures 116, 117 in the members 98, 99 respectively. The operating levers 108, 109 are yieldingly urged in one direction by means of springs 118, 119 so that the pins 113, 114 extend through the respective apertures 116, 117 and into a selected aperture 103, 104 in the discs, 101, 102 respectively. Thus, the members 98, 99 and therefore the support frames 47, 48 may be selectively positioned in a predetermined rotary position on the angular path through which the support frames swing thereby permitting the user to begin lateral movement of the legs at any predetermined angle. In other words, the user may position the legs in closely spaced relationship and swing the legs outwardly and laterally in one direction only or may begin the lateral leg movement at some intermediate position so that the legs may be swung inwardly and outwardly along the arcuate path so as to exercise the inner and outer thigh muscles in both directions.

Having thus described the preferred embodiment of the invention it should be understood that numerous structural modifications and adaptations may be resorted to without departing from the spirit of the invention.

What is claimed is:

1. Apparatus for exercising the inner and outer muscles of the thigh comprising, in combination, a frame, a seat on said frame, a weight cage on said frame, weight means guideably disposed in said weight cage for vertical movement between a rest position and an elevated position, leg receiving means on said frame for each of the leg's of a user, means for pivotally mounting each of said leg receiving means for independent rotary movement in an arcuate path from a predetermined rotary position and drive means for drivably connecting each of said mounting means to said weight means, said drive means being adapted to move said weight means from said rest position corresponding to said predetermined rotary position of said leg receiving means on said arcuate path into said elevated position by a lateral movement of the user's legs for exercising the inner and outer thigh muscles of the user wherein, said mounting means includes means for adjusting said predetermined rotary position of said mounting means defined by plate members fixed to said drive means having plural apertures thereon and engagable to said leg receiving means by operating lever means pivoted to said leg receiving means, said operating lever means having a pin element adapted to reside within one of said apertures for locking engagement thereby reorienting said leg receiving means relative to each said plate member.

2. Apparatus in accordance with claim 1 wherein said drive means are arranged to move said weight means from said rest position to said elevated position in either direction of pivotal movement of said leg receiving means on said arcuate path from said predetermined rotary position.

3. Apparatus in accordance with claim 1 wherein each of said leg receiving means comprises a pair of pads arranged in spaced-apart relationship on said mounting means, said pads being arranged to snugly accommodate the knee portion of the user's legs.

4. Apparatus in accordance with claim 3 including means for adjusting the spaced-apart relationship of each of said pairs of pads.

5. Apparatus in accordance with claim 4 including a foot rest on each of said leg receiving means.

6. Apparatus in accordance with claim 5 wherein each of said mounting means comprises a vertically extending shaft rotatably mounted on said frame, a support frame mounted on said shaft forwardly of said frame for pivotal movement in said arcuate path, said leg receiving means being mounted on said support frame.

7. Apparatus in accordance with claim 6 wherein said drive means includes a pair of D-shaped cams rotatably mounted on said frame in side-by-side relationship, chain and sprocket means for connecting said pair of cams to said weight means and a chain and sprocket assembly for drivably connecting each of said vertically extending shafts to an associated one of said cams.

8. Apparatus in accordance with claim 7 wherein each of said chain and sprocket assemblies includes a pair of sprockets rotatably mounted on opposite sides of said D-shaped cam in coaxial relationship with said cam, an intermediate spocket rotatably mounted on said frame, a sprocket on said vertically extending shaft, a continuous chain extending over said vertical shaft sprocket, under said pair of sprockets on opposite sides of said cam and over said intermediate sprocket and means for drivably connecting each of said pair of sprockets alternatively to said cam in accordance with the direction of advance of said chain for rotation of said cam in the same direction in either direction of advance of said chain.

9. Apparatus for exercising the inner and outer muscles of the thigh comprising, in combination, a frame, a seat on said frame, a weight cage on said frame, weight means guideably disposed in said weight cage for vertical movement between a rest position and an elevated position, leg receiving means on said frame for each of the leg's of a user, means for pivotally mounting each of said leg receiving means for independent rotary movement in an arcuate path from a predetermined rotary position and drive means for drivably connecting each of said mounting means to said weight means, said drive means being adapted to move said weight means from said rest position corresponding to said predetermined rotary position of said leg receiving means on said arcuate path into said elevated position by a lateral movement of the user's legs for exercising the inner and outer thigh muscles of the user wherein each of said mounting means comprises a vertically extending shaft rotatably mounted on said frame, a support frame mounted on said shaft forwardly of said frame for pivotal movement in said arcuate path, said leg receiving means being mounted on said support frame, wherein said drive means includes a pair of D-shaped cams rotatably mounted on said frame in side-by-side relationship, chain and sprocket means for connecting said pair of cams to said weight means and a chain and sprocket assembly for drivably connecting each of said vertically extending shafts to an associated one of said cams, each of said chain and sprocket assemblies includes a pair of sprockets rotatably mounted on opposite sides of said D-shaped cam in coaxial relationship with said cam, an intermediate sprocket rotatably mounted on said frame, a sprocket on said vertically extending shaft, a continuous chain extending over said vertical shaft sprocket, under said pair of sprockets on opposite sides of said cam and over said intermediate sprocket and means for drivably connecting each of said pair of sprockets alternatively to said cam in accordance with the direction of advance of said chain for rotation of said cam in the same direction in either direction of advance of said chain.

10. Apparatus in accordance with claim 8 or 9 wherein said, chain and sprocket means comprise a sprocket rotatably mounted on said weight means, a pair of idler sprockets mounted on said weight cage in laterally spaced relationship and a chain having ends connected to a respective one of said cams, said chain extending from one of said cams, over one of said idler sprockets, under said weight means sprocket, over said other idler sprocket and to the other of said cams.

11. The apparatus in accordance with claim 10 wherein said means for driveably connecting each of said pair of sprockets alternatively to said cam comprises a sleeve attached to each side of said cam having diametrically opposed pins extending outwardly therefrom, a sleeve mounted on each said sprocket on a face proximate to said cam, and a pair of diametrically opposed pins on said sprocket sleeve adapted to engage said pins on said cam sleeve for selective engagement therewith.

12. The device of claim 9 including drive means arranged to move said weights means from said rest position to said elevated position in either direction of pivotal movement of said leg receiving means on said arcuate path from said predetermined rotary position.

13. The device of claim 12 including mounting means wherein said mounting means includes means for adjusting said predetermined rotary position of said mounting means.

14. The device of claim 12 including leg receiving means comprising a pair of pads arranged in spaced-apart relationship on said mounting means, said pads being arranged to snugly accommodate the knee portion of the user's legs.

15. The device of claim 14 including means for adjusting the spaced-apart relationship of each of said pairs of pads.

16. The device of claim 15 including a foot rest on each of said leg receiving means.

* * * * *